US009368085B2

(12) United States Patent
Li et al.

(10) Patent No.: US 9,368,085 B2
(45) Date of Patent: Jun. 14, 2016

(54) METHOD AND APPARATUS FOR DRIVING ACTIVE MATRIX DISPLAY PANEL, AND DISPLAY

(71) Applicant: Shanghai Tianma Micro-Electronics Co., Ltd., Shanghai (CN)

(72) Inventors: Hong Li, Shanghai (CN); Shuai You, Shanghai (CN)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 22 days.

(21) Appl. No.: 13/939,160

(22) Filed: Jul. 10, 2013

(65) Prior Publication Data

US 2013/0328855 A1 Dec. 12, 2013

Related U.S. Application Data

(63) Continuation of application No. PCT/CN2012/086913, filed on Dec. 7, 2012.

(51) Int. Cl.
*G09G 3/36* (2006.01)

(52) U.S. Cl.
CPC ..... *G09G 3/3696* (2013.01); *G09G 3/3655* (2013.01); *G09G 2320/0219* (2013.01); *G09G 2320/0233* (2013.01)

(58) Field of Classification Search
None
See application file for complete search history.

(56) References Cited

U.S. PATENT DOCUMENTS 7,952,547 B2 5/2011 Wei
2007/0024560 A1* 2/2007 Kim et al. ..... 345/94
2008/0074404 A1 3/2008 Sashida
2008/0123026 A1 5/2008 Kwag et al.
2008/0136764 A1 6/2008 Kim et al.
2009/0184319 A1* 7/2009 Kim et al. ..... 257/59
2011/0001690 A1* 1/2011 Mori et al. ..... 345/87
2011/0267567 A1* 11/2011 Ting et al. ..... 349/123
2012/0062543 A1* 3/2012 Suyama et al. ..... 345/212

(Continued)

FOREIGN PATENT DOCUMENTS

CN TW200813927 A 9/1995
CN TW200823824 A 11/1995
CN 1825415 A 8/2006

(Continued)

OTHER PUBLICATIONS

Office Action for Korean Application No. 10-2013-7021261, mailed Jul. 22, 2014, 11 pages total.

(Continued)

*Primary Examiner* — Kent Chang
*Assistant Examiner* — Nathan Brittingham
(74) *Attorney, Agent, or Firm* — Alston & Bird LLP

(57) ABSTRACT

A method and apparatus for driving an active matrix display panel includes a plurality of scanning lines, a plurality of data lies intersecting the scanning lines, and a plurality of pixel electrodes that are coupled to the scanning lines and the data lines. The method includes activating the scanning lines sequentially, and adjusting common voltages applied to a plurality of common electrodes that are disposed opposite to the pixel electrodes in response to differences in voltage changes generated among the pixel electrodes when the scanning lines changes from an on state to an off state. Therefore a voltage difference between each of the pixel electrodes and a common electrode arranged opposite to the pixel electrode is equal to a target voltage.

16 Claims, 6 Drawing Sheets

(56) References Cited

U.S. PATENT DOCUMENTS

| | | | | |
|---|---|---|---|---|
| 2012/0113084 | A1 | 5/2012 | Yang et al. | |
| 2013/0201163 | A1 * | 8/2013 | Tseng et al. | 345/204 |

FOREIGN PATENT DOCUMENTS

| | | | |
|---|---|---|---|
| CN | 101191925 | A | 6/2008 |
| CN | 101197121 | A | 6/2008 |
| CN | 101202018 | A | 6/2008 |
| CN | 101847376 | A | 9/2010 |
| CN | 102314010 | A | 1/2012 |
| JP | 2008-146009 | A | 6/2008 |
| JP | 2009-222786 | A | 1/2009 |
| KR | 1020030056526 | A | 7/2003 |

OTHER PUBLICATIONS

Notice of Allowance for Korean Application No. 10-2013-7021261, mailed on Jan. 22, 2015, 3 pages total.

European Search Report as issued in corresponding European Application No. 12870335.2, dated Sep. 22, 2015.

* cited by examiner

METHOD AND APPARATUS FOR DRIVING ACTIVE MATRIX DISPLAY PANEL, AND DISPLAY

CROSS-REFERENCES TO RELATED APPLICATIONS

The present application claims priority to and is a continuation of International patent application PCT/CN2012/086193, entitled "METHOD AND APPARATUS FOR DRIVING ACTIVE MATRIX DISPLAY PANEL, AND DISPLAY", filed on Dec. 7, 2012, which claims priority to Chinese patent application No. 201210187110.4, entitled "METHOD AND APPARATUS FOR DRIVING ACTIVE MATRIX DISPLAY PANEL, AND DISPLAY", filed with the State Intellectual Property Office of PRC on Jun. 7, 2012, the contents of which are incorporated herein by reference in their entirety.

FIELD OF THE INVENTION

The present invention relates to the field of the active matrix display technology, and in particular to a method and an apparatus for driving an active matrix display panel and a display.

BACKGROUND OF THE INVENTION

With the development of the liquid crystal display (LCD) technology, the desired resolution of the liquid crystal display is increasingly high, while the desired frame of the module is increasingly narrow. Therefore, more wires are distributed in the wiring region, resulting in increased density. In view of technical bottlenecks in the process such as requirements on minimum wiring width and spacing, double-layer scanning lines technology has been applied widely. In general, two different metal materials are used for manufacturing the scanning lines, but since the resistivity of the two metal materials is different, it is important to match the resistance values of the two metal scanning lines. Thus, line width and film thickness of the scanning lines have to be calculated accurately in the design process and to be controlled strictly in the manufacture process. However, fluctuations and errors in the design or manufacturing process may cause mismatch between the resistance values of the two layers of scanning lines, resulting in different feed-through voltages of TFTs (Thin Film Transistors), and poor uniformity of a display. For example, horizontal strips of a gray scale image may appear in the display, which degrades the image display quality.

In order to solve the problems above, conventional techniques promote a method that uses two kinds of metal wirings for each of the scanning lines to reduce the difference caused by the two materials themselves. When the method is used in practical design, the resistance of each wiring has to be simulated accurately to control the resistance of each wiring electrode. Since each gate electrode is formed by two kinds of metal wirings, and via-hole connections are required in the manufacture process, the complexity of the manufacturing process is increased and the production yield is affected. Also, although the resistance of each scanning line is simulated, actual fluctuations in the manufacturing process may result in resistance mismatch, and the displayed image quality is poor.

Chinese patent application publication No. CN1825415A, titled "LIQUID CRYSTAL DISPLAY DEVICE PERFORMING DOT INVERSION AND METHOD FOR DRIVING THE SAME" discloses various methods for driving an LCD panel.

BRIEF SUMMARY OF THE INVENTION

Embodiments of the present invention provide a method for driving an active matrix display panel. The active matrix display panel generally comprises scanning line driving circuit configured to drive a plurality of scanning lines, a plurality of data lines intersecting with the plurality of scanning lines, a plurality of pixel electrodes provided in regions that are surrounded by adjacent scanning lines and adjacent data lines. The pixel electrodes are coupled to the scanning lines through capacitive coupling and to the data lines through electronic switches. The active matrix display also includes a common electrode driving circuit configured to apply a plurality of common voltages to a plurality of common electrodes that are disposed opposite to the pixel electrodes. The method for driving the active matrix display panel comprises: activating the scanning lines sequentially by the scanning line driving circuit; and adjusting the common voltages in response to differences in voltage changes among the pixel electrodes when the scanning lines change from an on state to an off state, so that a voltage difference between each of the pixel electrodes and a common electrode arranged opposite to the pixel electrode is substantially equal to a target voltage.

Embodiments of the present invention also provide a display for reducing the effect of feed-through voltages on the pixel electrodes. The display includes an active matrix display panel having a plurality of scanning lines, a plurality of data lines intersecting with the plurality of scanning lines, a plurality of pixel electrodes provided in regions surrounded by adjacent scanning lines and adjacent data lines. The pixel electrodes are coupled to the scanning lines through capacitive coupling and to the data lines through electronic switches. The active matrix also includes a plurality of common electrodes that are disposed opposite to the pixel electrodes. The display comprises a scanning line driving circuit configured to apply scanning voltages to the scanning lines, a data line driving circuit configured to apply data voltages to the data lines, and a common electrode driving circuit configured to apply common voltages to the common electrodes. The common electrode driving circuit adjusts the common voltages in response to differences in voltage changes among the pixel electrodes that are generated when the scanning lines change from an on state to an off state, so that a voltage difference between each of the pixel electrodes and a common electrode arranged opposite to the pixel electrode is substantially equal to a target voltage.

DETAILED DESCRIPTION OF THE INVENTION

Embodiments of the present invention provide a method and apparatus for driving an active matrix display panel, and a display for reducing voltage changes of pixel electrodes that are generated through capacitive coupling when the scanning lines change states. Embodiments of the present provide novel solutions, in which only common voltages of common electrodes are adjusted to counteract the effects of feed-through voltages on the pixel voltages when the scanning lines change from an on state to an off state, without changing the structure of the active matrix display panel. Therefore, the complexity of manufacturing process is reduced, and the production yield is improved. Furthermore, common voltages applied to the common electrodes are adjusted by setting a register in a common electrode driving circuit during a line blanking period of the scanning line driving circuit. The line blanking period includes a period during which the row synchronizing signal is at a low level. Therefore, adjusting the common voltages applied to the common electrodes during this period will not affect normal display of the active matrix display panel.

More specific details will be set forth in the following descriptions for sufficient understanding of the invention. However, the invention can also be implemented by other ways different from the ways described herein, and similar extensions can be made by those skilled in the art without departing from the spirit of the invention. Therefore, the invention is not limited to the specific embodiments disclosed hereinafter.

In order to understand the technical solution of the present invention, the principle of generating the feed-through voltage and the influence of the feed-through voltage on the pixel voltage are described for the active matrix display panel in detail below.

Figure 1A:
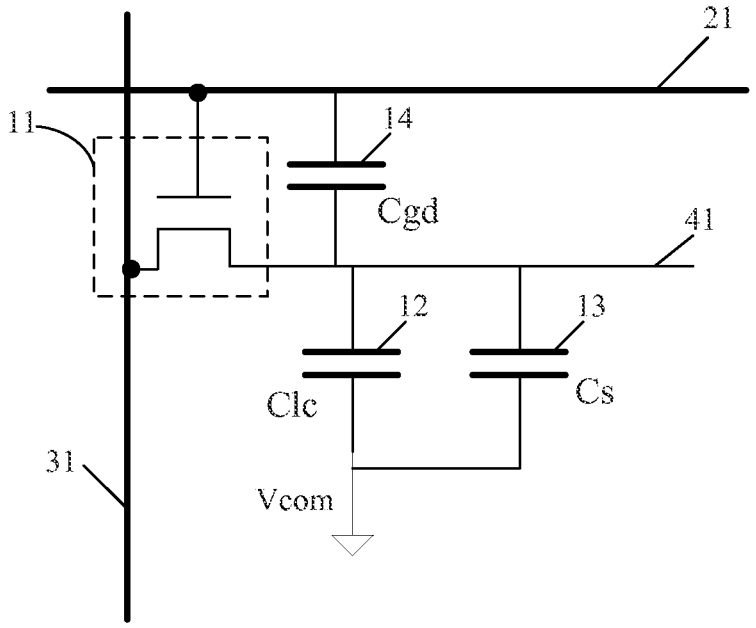
FIG. 1A is an equivalent circuit diagram of a pixel unit in an active matrix display panel according to an embodiment of the present invention.
Figure 1B:
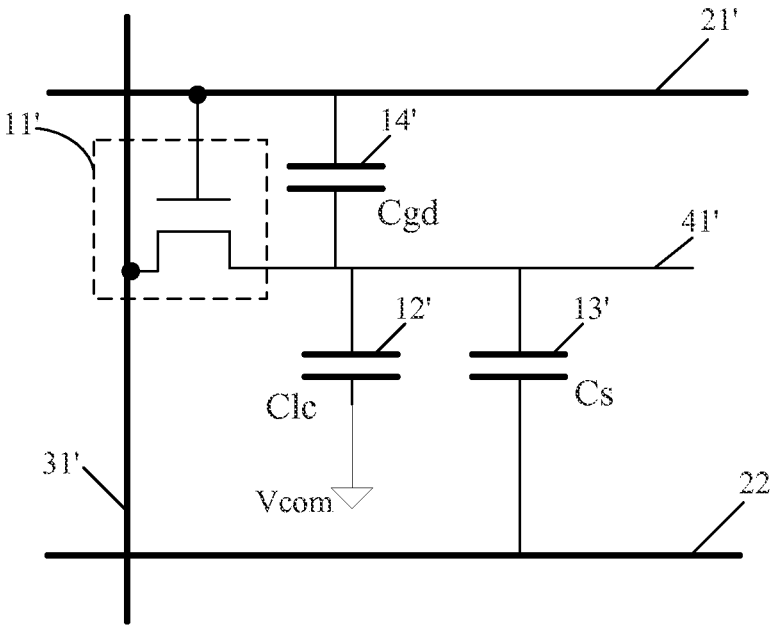
FIG. 1B is an equivalent circuit diagram of another pixel unit in an active matrix display panel according to another embodiment of the present invention.

FIGS. 1A and 1B are equivalent circuit diagrams of pixel units in an active matrix display panel according to embodiments of the present invention. In the pixel unit illustrated in FIG. 1A, a storage capacitor Cs is formed by using a pixel electrode and a common electrode, and is referred to as Cs on common. In the pixel unit illustrated in FIG. 1B, a storage capacitor Cs is formed by using a pixel electrode and a next gate wire (i.e., scanning line), and is referred to as Cs on gate. The principles of generating the feed-through voltage are the same for the pixel units of the two circuit structures, and it is described below by taking the schematic diagram of the circuit structure of the pixel unit illustrated in FIG. 1A as an example.

Referring to FIG. 1A, the pixel unit includes a TFT switch 11, a scanning line 21 connected to the gate electrode of the TFT switch, a data line 31 connected to the source/drain electrode of the TFT switch (an electronic switch), and a pixel electrode 41 connected to the drain/source electrode of the TFT switch. The pixel unit also includes an active matrix capacitor Clc 12 and a storage capacitor Cs 13 connected in parallel between the pixel electrode 41 and a common electrode Vcom. The pixel unit also includes a parasitic capacitor Cgd 14 that is formed between the gate electrode and the source/drain electrode of the TFT switch.

The voltage applied to the gate electrode of the TFT switch 11 changes at the moment when the scanning line 21 turns on or off, which affects a voltage change of the pixel electrode 41 via the parasitic capacitor Cgd 14. Specifically, when the voltage of scanning line 21 turns on (i.e., rises to a high level), an upward feed-through voltage is generated thanks to a capacitive coupling via the parasitic capacitor Cgd 14 and applied to the pixel electrode 41. But the scanning line 21 at this time is in an on state, and data signal applied to the data line 11 starts to charge or discharge the pixel electrode 41. Therefore, although the initial voltage on the pixel electrode 41 is not correct due to the feed-through voltage, the gray scale display of the pixel unit is not greatly affected by the generated feed-through voltage when the scanning line 21 turns on because the data signal charges/discharges the pixel electrode 41 to reach a correct voltage.

However, when the scanning line 21 turns off, the TFT switch is turned off and the data signal applied to the data line 31 stops charging the pixel electrode 41 and at this time a downward feed-through voltage is generated on the pixel electrode 41 via the parasitic capacitor 14. The feed-through voltage will continuously affect the voltage of the pixel electrode 41 until the scanning line 21 turns on next time. Thus the correctness of the gray scale display will be greatly influenced. Therefore, embodiments of the present invention provide solutions to compensate the voltage change (downward feed-through voltage) generated on the pixel electrode when the scanning line turns from an on state to an off state (i.e., when the square-wave voltage applied to the scanning line is at a falling edge) so as to maintain a correct gray scale display.

In addition, on the active matrix display panel, the scanning signal generated by the scanning line driving circuit is transmitted to the pixel units that are connected to the scanning line driving circuit via each of row scanning lines. Since the scanning line itself has a resistance (the resistance of the scanning line includes the resistance of the scanning line located in the pixel array region and the resistance of the scanning line wiring located in the wiring region around the pixel array region), and a parasitic capacitance is formed between the scanning line and other metal or non-metal layers on the active matrix display panel, each of the pixel units can be considered to be equivalent to a resistor-capacitor circuit (i.e., an RC circuit). Therefore, a signal delay will occur when a scanning signal in each row is transmitted to the pixel units connected to that row, and the delay time is directly proportional to the product of the resistance and the capacitance of the associated scanning line.

In an embodiment of the present invention, the wiring region of the active matrix display panel may include scanning lines having different resistances. For example, the active matrix display panel may include scanning lines made of two different materials, or scanning lines having different line widths, or scanning lines made of different materials and having different line widths, all of which will result in different resistance values of the scanning lines. Thus, the signal delay time may be different in the scanning signal transmission. Therefore, when the scanning lines turn from an on state to an off state, voltage changes of the pixel electrodes coupled to the different scanning lines are different, i.e., the feed-through voltages of the pixels corresponding to the different scanning lines are different. Therefore, in a case where the data signal applied to the data line is unchanged, the feed-through voltages of different pixel electrodes can be compensated by adjusting the common voltages applied to the common electrodes, so that the pixel voltage applied to each of the pixel units is equal to a target voltage. Therefore, the gray scale display of the pixel unit is correct, and the quality of the image display is optimized.

Figure 2:
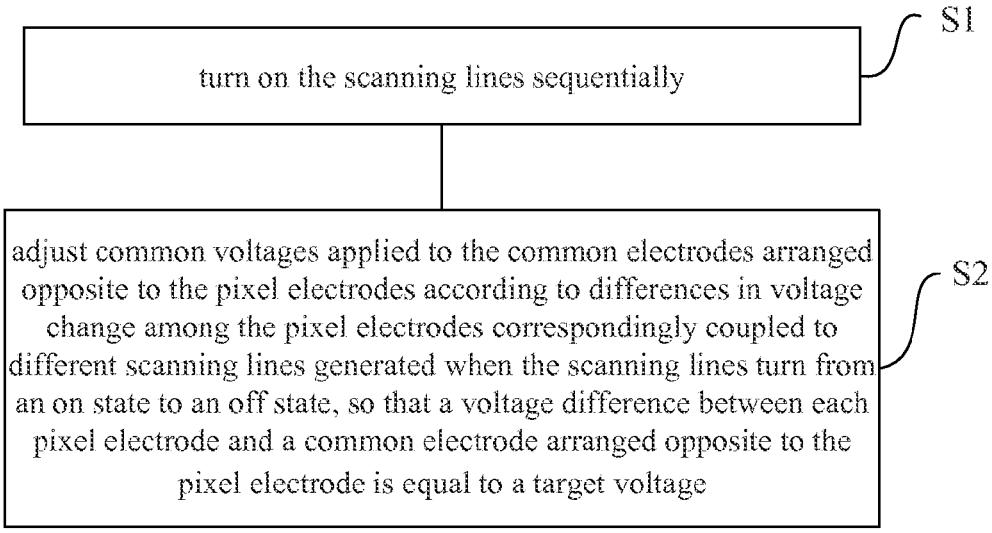
FIG. 2 is a schematic flowchart of a method for driving an active matrix display panel according to an embodiment of the present invention.

FIG. 2 is a schematic flowchart of a method for driving an active matrix display panel according to an embodiment of the present invention. Referring to FIG. 2, the method for driving the active matrix display panel includes:

Step S1: turning on the scanning lines sequentially;

Step S2: adjusting common voltages applied to common electrodes that are arranged opposite to pixel electrodes in response to differences in voltage changes among the pixel electrodes when the scanning lines turn from an on state to an off state, so that a voltage difference between each of the pixel electrodes and a common electrode is equal to a target voltage.

In an embodiment, the active matrix panel includes: a plurality of scanning lines, a plurality of data lines intersecting with the plurality of scanning lines, a plurality of pixel electrodes arranged (disposed) in regions surrounded by adjacent scanning lines and adjacent data lines. A pixel electrode is capacitively coupled to an associated scanning line and to an associated data line through an electronic switch (e.g., TFT 11 in FIG. 1A, TFT 11' in FIG. 1B). The active matrix panel also includes a plurality of common electrodes that are arranged opposite to the pixel electrodes. The term "coupling to" or "coupled to" refers to "directly or indirectly connected with". For example, the pixel electrodes are indirectly coupled to the scanning lines through a capacitance between the gate electrode and the source and drain electrodes Cgd (see FIGS. 1A, 1B). The pixel electrodes are electrically connected to the data lines through thin film transistors (TFTs). The gate electrode of the TFTs is electrically connected with the scanning line, the source/drain electrode of the TFT is electrically connected with the data line, and the drain/source electrode of the TFT is electrically connected with the pixel electrode.

In an embodiment, the active matrix panel may be a conventional pixel array structure in which a row of pixel units is controlled by a scanning line, and a column of pixel units is controlled by a data line. The active matrix panel may also have a pixel array structure referring to as a dual gate structure, in which a row of pixel units is controlled by two scanning lines, and two adjacent columns of pixel units share a same data line. These two pixel array structures of the active matrix display panel will be described in detail below in conjunction with FIG. 3 and FIG. 4.

Figure 3:
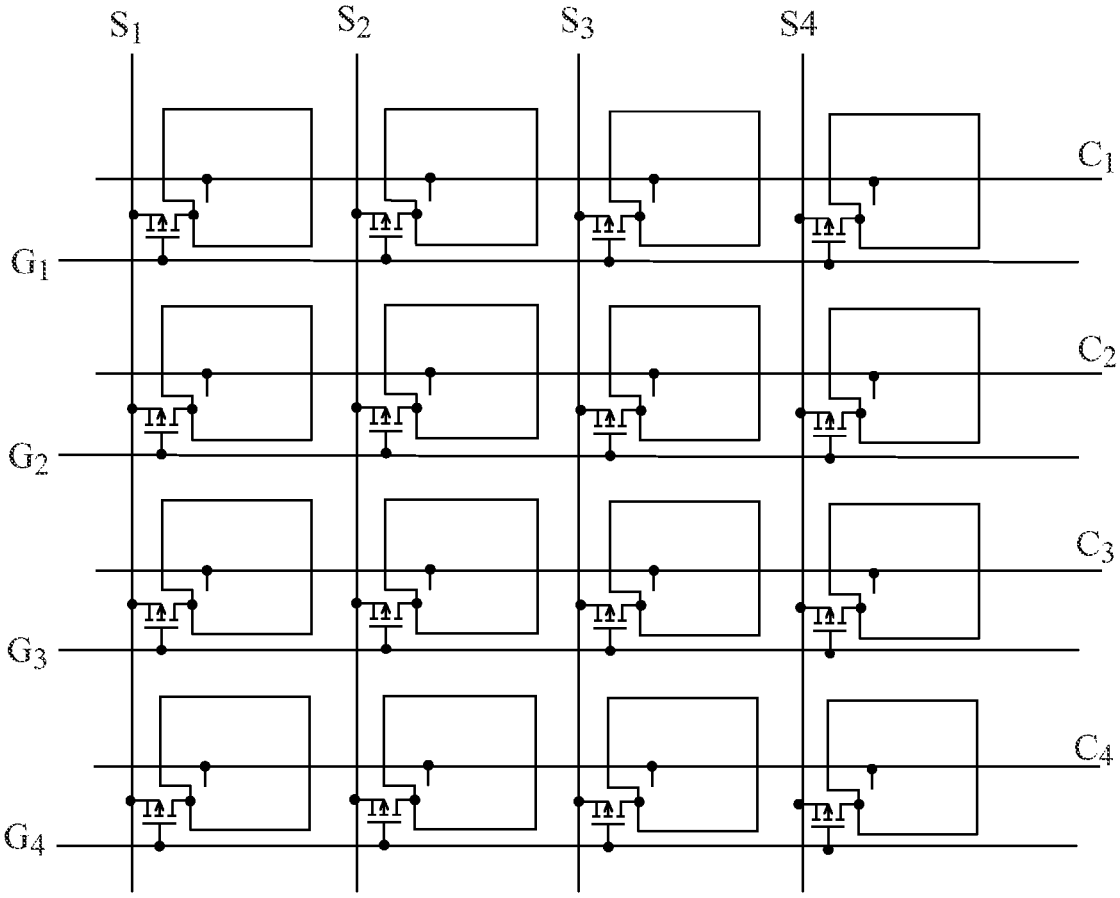
FIG. 3 is a structural schematic diagram of a pixel array in an active matrix display panel according to an embodiment of the present invention.

FIG. 3 is a structural schematic diagram of the pixel array in the conventional active matrix display panel. Referring to FIG. 3, the pixel array includes a plurality of pixel units each containing a thin film transistor (TFT), a plurality of scanning lines G1, G2, G3, G4, extending in a horizontal direction and connecting to gate electrodes of the TFTs in the pixel units, and adapted for supplying scanning signals to the pixel units so as to turn on the TFTs, a plurality of data lines S1, S2, S3, S4, extending in a vertical direction and connecting to first electrodes (for example, source electrodes or drain electrodes) of the TFTs in the pixel units, and configured to supply data signals to the pixel electrodes in the pixel units. The pixel array also includes a plurality of common electrode lines C1, C2, C3, C4, configured to supply common voltages to common electrodes in the pixel units. In an embodiment, the scanning lines G1, G2, G3, G4 are double-layer wirings, i.e., scanning signals configured to turn on the TFTs are supplied to the pixel units using two scanning lines with different resistance values and disposed at different layers.

Figure 4:
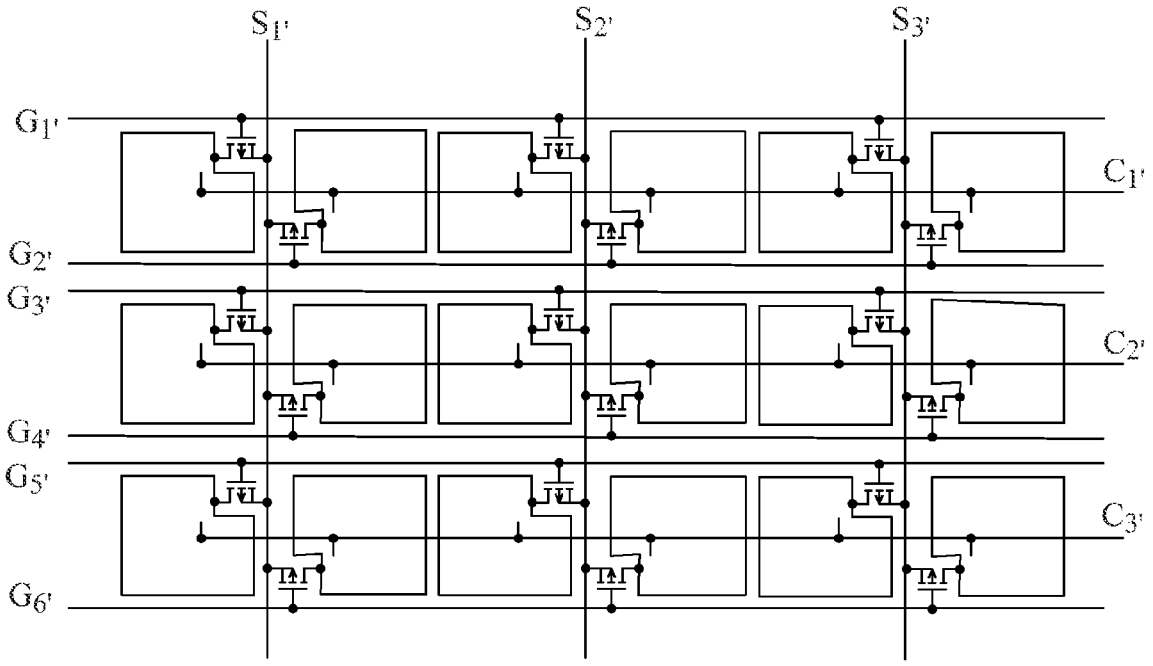
FIG. 4 is a structural schematic diagram of a pixel array in another active matrix display panel according to an embodiment of the present invention.

FIG. 4 is a structural schematic diagram of a pixel array in an active matrix display panel which uses a dual gate structure. Referring to FIG. 4, the pixel array includes: a plurality of pixel units containing a plurality of thin film transistors; a plurality of scanning lines G1', G2', G3', G4', G5', G6', extending in the horizontal direction and connecting to gate electrodes of the TFTs in the pixel units, and configured to supply scanning signals to the pixel units so as to turn on the TFTs. The pixel array also includes a plurality of data lines S1', S2', S3', extending in the vertical direction and connecting to first electrodes (for example, source electrodes or drain electrodes) of the TFTs in the pixel units, and configured to supply data signals to the pixel electrodes in the pixel units; and common electrode lines C1', C2', C3' electrically connected with each other and configured to supply common voltages to common electrodes in the pixel units. In the embodiment, the scanning lines G1', G2', G3', G4', G5', G6' include double-layer wirings, i.e., scanning voltages configured to turn on the TFTs are supplied to the pixel units using scanning lines with different resistance values.

Different from the conventional pixel array, according to an embodiment, in the dual gate structure, two scanning lines are connected alternately to pixel units in a row. In an example embodiment, the scanning line G1' is connected to pixel units in odd-numbered column of a first row, and the scanning line G2' is connected to pixel units in even-numbered column of the first row. Each data line is disposed between two adjacent columns of pixel units.

It should be noted that, in the pixel array structures of the active matrix display panels as illustrated in FIG. 3 and FIG. 4, each of the common electrode lines may be driven by a same output terminal of the common electrode driving circuit. Therefore, the common voltages applied to all the common electrode lines are the same at the same time. Each of the common electrode lines may also be driven by a different output terminal of the common electrode driving circuit respectively, i.e., the number of the output terminals of the common electrode driving circuit is the same as the number of the common electrode lines, and each of the common electrode lines corresponds to one of the output terminals. Therefore, the common voltage applied to each of the common electrode lines may be different at the same time.

The method for driving the active matrix display panel provided by the present technical solution may be used in the two pixel array structures described above, but it is not limited herein in the practical application.

In an embodiment, as described in Step S1, the scanning lines are turned on (or activated) sequentially.

In general, scanning signals are applied to each of the scanning lines sequentially from top to bottom of the pixel array, and TFTs associated with the scanning lines in the pixel units are turned on row by row. In an embodiment, the scanning signals applied to the scanning lines are alternating square-wave voltage signals, and the TFTs in the pixel unit connected to an associated scanning line are turned on when the associated scanning signal rises to a high level. Taking an active matrix display panel having a resolution of 1024*768 as an example, the update frequency of the active matrix display panel is generally 60 Hz, the time for displaying each of the images is 1/60 Hz=16.67 ms, and the turn-on time assigned to each of the scanning lines is 16.67 ms/768=21.7 us since there are a total of 768 rows of scanning lines. Therefore, the applied scanning signals are pulse square-wave signals with the width of 21.7 us.

As described in Step S2, the common voltages applied to the common electrodes are adjusted in response to differences in voltage changes among the pixel electrodes that are coupled to different scanning lines. The differences in voltage changes are generated when the scanning lines change from an on state to an off state, so that a voltage difference between each of the pixel electrodes and a common electrode disposed opposite to the associated pixel electrode is equal to a target voltage.

As described above with respect to FIG. 1A and FIG. 1B, each of the scanning signals applied to the scanning line changes greatly when the associated scanning lines changes from an on state to an off state. The feed-through voltage is generated on the pixel electrode via the parasitic capacitor between the gate electrode and the drain electrode of the TFT, which leads to a sudden change of the voltage of the pixel electrode.

Referring to FIG. 1A, let's assume that the gate voltage is Vg1 and the pixel electrode voltage is Vd1 when the scanning line turns on; and the gate voltage is Vg2 and the pixel electrode voltage is Vd2 when the scanning line turns off. In the ideal case, the gate voltage changes instantaneously, and the charge is Qopen=(Vd1−Vg1)*Cgd+(Vd1−Vcom)*(Clc+Cs) when the scanning line turns on. The charge Qopen is equal to Qclose=(Vd2−Vg2)*Cgd+(Vd2−Vcom)*(Clc+Cs) when the scanning line turns off according to the law of conservation of charge. Therefore, it is obtained that the feed-through voltage generated on the pixel electrode, i.e., the change of the pixel electrode voltage when the scanning line changes from an on state to an off state is ΔV=Vd2−Vd1=(Vg2−Vg1)*Cgd/(Cgd+Clc+Cs). However, in the practical application, a period of time is needed when the scanning line changes from an on state to an off state. Therefore, when considering the change of the pixel electrode voltage, a further optimization may be performed, i.e., the change of the pixel electrode voltage is: $\Delta V_1$=Vd2−Vd1=(Vg2−Vg1)*Cgd/(Cgd+Clc+Cs)+F(I, t, R, C), where t in the function F (I, t, R, C) is 0 (zero) in the ideal case. However, in a non-ideal case, the time can be different due to the RC time delay of the scanning line having different resistance values, so the amount of the voltage change is different.

In the function F(I, t, R, C), I is a current flowing between the pixel electrode and the data line, t is the time for the TFT to switch from on to off, R is the resistance of the scanning line, and C is the capacitance formed by the scanning line and other metal layers on the active matrix display panel.

In other embodiments, in addition to the parasitic capacitor Cgd, the storage capacitor Cs and the active matrix capacitor Clc described above, the capacitor connected to the pixel electrode in each of the pixel units may also include a capacitor Cpd of a data line of the pixel unit itself, a capacitor Cpd' of a data line of an adjacent pixel unit, a capacitor Cpg of a scanning line of the pixel unit itself, and a capacitor Cpg' of a scanning line of an adjacent pixel unit.

In this case, the feed-through voltage generated on the pixel electrode can be described as:

$$\Delta V_2 = Vd2' - Vd1' = (Vg2 - Vg1)*(Cgd+Cpg)/(Cgd+Clc+Cs+Cpd+Cpd'+Cpg+Cpg')+F(I, t, R, C),$$

where in the function F(I, t, R, C), I is a current flowing between the pixel electrode and the data line, t is the time for the TFT switching from on to off, R is the resistance of the scanning line, and C is the capacitance formed by the scanning line and other metal layers or non-metal layers on the active matrix display panel. Therefore, the capacitive coupling effect of these capacitors has to be considered when determining the feed-through voltage of the pixel electrode of each of the pixel units.

In accordance with an embodiment of the present invention, the scanning lines with different resistances, such as scanning lines with different materials or scanning lines with different line widths, are used in the wiring region of the active matrix display panel. In this case, the scanning lines in the wiring region include double-layer wirings. When the scanning lines in the wiring region are different from the scanning lines in the display region, the scanning lines in the wiring region are arranged on source and drain layer, and are electrically connected to the scanning lines in the display region by via-holes. When the scanning lines in the wiring region are the same as the scanning lines in the display region, it is not required to form the above structure. In the practical application, the way to arrange the lines is not limited to the above, and various modifications, changes, and variations can be made without departing from the scope of the principle. Further, the scanning lines with the same resistance may be adopted in the display region (i.e., the pixel array region) of the active matrix display panel. In the process of transmitting the scanning signals generated by the scanning line driving circuit to the display region through the scanning lines with different resistances in the wiring region, since the RC delay time is different in the process of transmitting the scanning signals to each of pixel units through the scanning lines with different resistances, different feed-through voltages are generated on the pixel electrodes, which causes the differences of the pixel voltage changes. In the present embodiment, in a case that the scanning lines are manufactured with different materials, the first material includes a stack of metal layers made of aluminum/molybdenum and the second material includes a stack of metal layers made of molybdenum/aluminum/molybdenum. However, in the practical application, it is not limited herein.

In other embodiments, scanning lines with different resistances, such as scanning lines made of different materials or scanning lines with different line widths, may also be adopted in the display region of the active matrix display panel. Based on the same principle, in the process of transmitting the scanning signals generated by the scanning line driving circuit to each row of pixel units through the scanning lines with different resistances in the display region, since the RC delay time is different in the process of transmitting the scanning signals to each of pixel units through the scanning lines with different resistances, different feed-through voltages are generated on the pixel electrodes, which cause the differences of the pixel voltage changes.

Therefore, in this step, the different feed-through voltages generated on the pixel electrode can be compensated by adjusting the common voltage applied to the common electrode that is disposed opposite to the pixel electrode. In the present embodiment, the scanning signals applied to the pixel units connected to the scanning lines with the same resistance are consistent. Therefore, the adjusted amplitude of the common voltage signal is the amount of the changes among different feed-through voltages.

In an example embodiment, two different scanning lines are used in the active matrix display panel. Firstly, only a first scanning line is driven by the scanning line driving circuit so as to turn on the TFTs in the pixel units connected to the first scanning line and charge/discharge the pixel electrodes through the data lines connected to the pixel units. Then, a first feed-through voltage is measured by a voltage measuring device when the first scanning line changes from an on state to an off state. Subsequently, only the second scanning line is driven by the scanning line driving circuit so as to turn on the TFTs in the pixel units connected to the second scanning line and charge/discharge the pixel electrodes through the data lines connected to the pixel units. Then, a second feed-through voltage is measured by the voltage measuring device when the second scanning line changes from an on state to an off state.

Further, based on the difference between the first feed-through voltage and the second feed-through voltage described above, the value of the register in the common electrode driving circuit is adjusted to make the pixel voltage of the pixel units in each row equal to the target voltage. Specifically, the common voltage signal applied to the common electrode line may be adjusted by setting the register in the common electrode driving circuit during a line blanking period of the scanning line driving circuit. The line blanking period includes a period during which a row synchronizing signal is at a low level. Specifically, the line blanking period includes a synchronizing front porch stage, a synchronizing back porch stage, and the like. It will be appreciated that adjusting the common voltage signal by setting the register in the common electrode driving circuit during the line blanking period will not affect the normal display of the active matrix display panel.

In an embodiment, the target voltage may be determined according to the expression: $\Delta V_f = V'_f + \Delta V'_f(I,t,R,C)$, where $\Delta V_f$ is the feed-through voltage, $V'_f$ is a fixed value, and $\Delta V'_f(I,t,R,C)$ is a function of I, t, R and C. In the function, I is the current flowing between the pixel electrode and the data line, t is the time for the TFT turning from on to off, R is the resistance of the scanning line, and C is the capacitance formed by the scanning line and other metal layers on the active matrix display panel.

The common electrode voltage can be described as:

$$V_c = V'_c + \Delta V'_c$$

where $V_c$ is the common electrode voltage, $V'_c$ is the common electrode voltage before compensation, and $\Delta V'_c$ is the compensation amount.

The pixel voltage can be described as:

$$V_p = V_d + \Delta V_f + V_c = V_d + V'_f + V'_c + (\Delta V'_f(I,t,R,C) + \Delta V'_c)$$

where Vp is the pixel voltage, and $V_d$ is the pixel electrode voltage. The target voltage is $V_d + V'_f + V'_c$, that is, the common electrode voltage is compensated so as to make $(\Delta V'_f(I,t,R,C) + \Delta V'_c)$ of the pixel voltage of the pixel unit controlled by the scanning line with different resistance be 0, i.e., to make the value of $(\Delta V'_f(I,t,R,C) + \Delta V'_c)$ be a constant.

In other words, in a case where the data signal applied to the data line is unchanged, different feed-through voltages generated on the different pixel electrodes are compensated by adjusting the common voltages applied to the common electrodes so that the pixel voltage applied to each of the pixel units is equal to the target voltage, which reduces the horizontal strips of the active matrix display panel and improves the image quality. The adjusted common voltages form an alternating square-wave voltage signal in a continuous period.

It should be noted that, in an embodiment, the common electrode is provided on a TFT substrate for an active matrix display panel. The active matrix display panel may include an In-Plane-Switching (IPS) type or a Fringe Field Switching (FFS) type. In another embodiment, the common electrode may also be provided on a CF (color filter) substrate, including a Twisted Nematic (TN) type or a Vertical Alignment (VA) type. The active matrix display panel may be one of an OLED display panel, an active matrix display panel and an electronic paper panel.

The method for driving the active matrix display panel according to embodiments of the present invention will be described below in conjunction with different polarity inversion modes of the active matrix display panel. It will be appreciated that the inversion mode of the polarity of the active matrix display panel mainly includes a frame inversion mode, a row inversion mode, a column inversion mode, and a dot inversion mode.

First Embodiment

The first embodiment is described with the structural schematic diagram of the pixel array in the active matrix display panel illustrated in FIG. 3 when driving in a row inversion mode. It is understood that FIG. 3 only shows a portion of the pixel array in the active matrix display panel. Moreover, the structure of the active matrix display panel herein is simplified, and only the portion relevant to the present solution is displayed. The pixel array structure in the active matrix display panel illustrated in FIG. 3 has been described in detail in sections above, and further description will be omitted herein for the sake of brevity.

In an embodiment, in the active matrix display panel, the scanning lines G1 and G2 are the same first scanning lines, and the scanning lines G3 and G4 are the same second scanning lines different from the first scanning lines. In other words, the scanning line G1 (or G2) is different from the scanning line G3 (or G4). For example, the scanning lines G1 and G2 are manufactured with a first material, and the scanning lines G3 and G4 are manufactured with a second material. In an embodiment, the first material is aluminum/molybdenum, and the second material is molybdenum/aluminum/molybdenum. But in the practical application, it is not limited to the metal materials described above. In another example embodiment, the scanning lines G1 and G2 may have a first line width, and the scanning lines G3 and G4 may have a second line width. In yet another example embodiment, the scanning lines G1 and G2, compared with the scanning lines G3 and G4, may be manufactured with different materials and have different line widths. In the practical application, the different scanning lines are not limited to be arranged as illustrated in FIG. 3. For example, the scanning lines may be arranged as follows: the scanning lines G1 and G3 are the same scanning lines and the scanning lines G2 and G4 are the same scanning lines.

Figure 5:
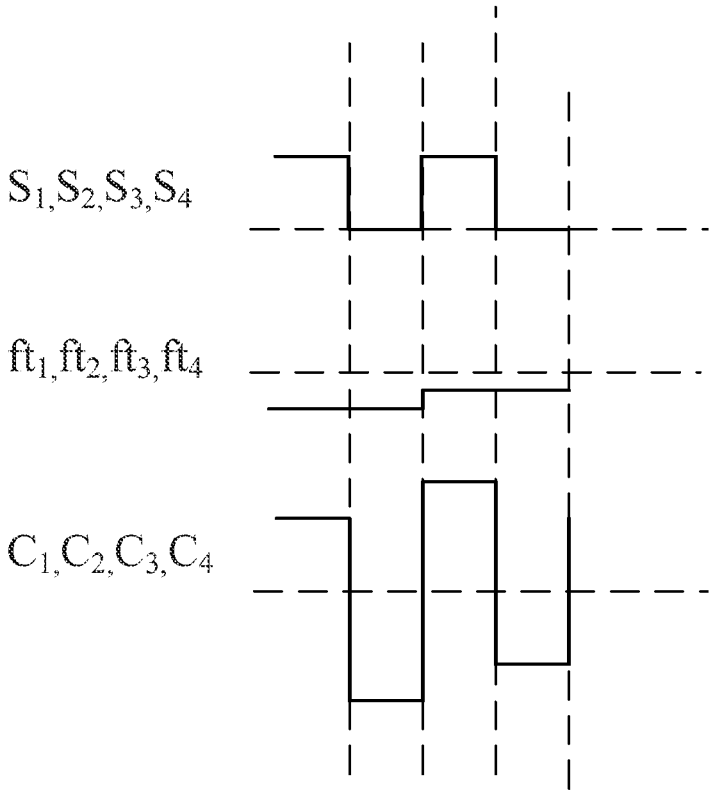
FIG. 5 is a diagram of state changes of signals applied to a pixel array of the active matrix display panel illustrated in FIG. 3 when driving in a row inversion mode according to an embodiment of the present invention is.

FIG. 5 is a diagram of state changes of signals of a pixel array of an active matrix display panel of FIG. 3 when driving in a row inversion mode.

In the row inversion mode, the data signal applied to the data lines S1, S2, S3, S4 is an alternating square-wave voltage signal. It is assumed that the high level of the data signal is 2V, the low level of the data signal is 0V, and the high level of the common electrode voltage originally applied to the common electrode is 4V, the low level of the common electrode voltage originally applied to the common electrode is −4V. As illustrated in FIG. 3, the scanning lines G1 and G2 are scanning lines with a first resistance, and the scanning lines G3 and G4 are scanning lines with a second resistance. It is assumed that the second resistance of the scanning lines G3 and G4 is larger than the first resistance of the scanning lines G1 and G2. Therefore, as illustrated in FIG. 5, the feed-through voltages generated by the scanning lines G1 and G2 on the pixel electrodes are larger (e.g., −1V), and the feed-through voltages generated by the scanning lines G3 and G4 on the pixel electrodes are smaller (e.g., −0.5V). Therefore, the common voltage signal applied to the common electrode is adjusted according to the different feed-through voltages generated by the different scanning lines on the pixel electrodes. As illustrated in FIG. 5, the adjusted common electrode voltages C1, C2, C3, C4 are alternating square-wave signal, in which the high level C1 of the common electrode voltage corresponding to the scanning lines G1 and G2 is 4V, the low level C2 of the common electrode voltage corresponding to the scanning lines G1 and G2 is −4V, the high level C3 of the common electrode voltage corresponding to the scanning lines G3 and G4 is 4.5V, and the low level C4 of the common electrode voltage corresponding to the scanning lines G3 and G4 is −3.5V. The corresponding level difference compensates the difference of the generated feed-through voltages.

Therefore, the pixel voltage ultimately applied to each of the pixel units is equal to the target voltage, that is, the pixel voltages applied to the pixel units connected to the scanning lines G1 and G2 are respectively |2V−1V−4V|=3V and |0V−1V−(−4V)|=3V, and the pixel voltages applied to the pixel units connected to the scanning lines G3 and G4 are respectively |2V−0.5V−4.5V|=3V and |0V−0.5V−(−3.5V)|=3V.

Second Embodiment

Figure 6:
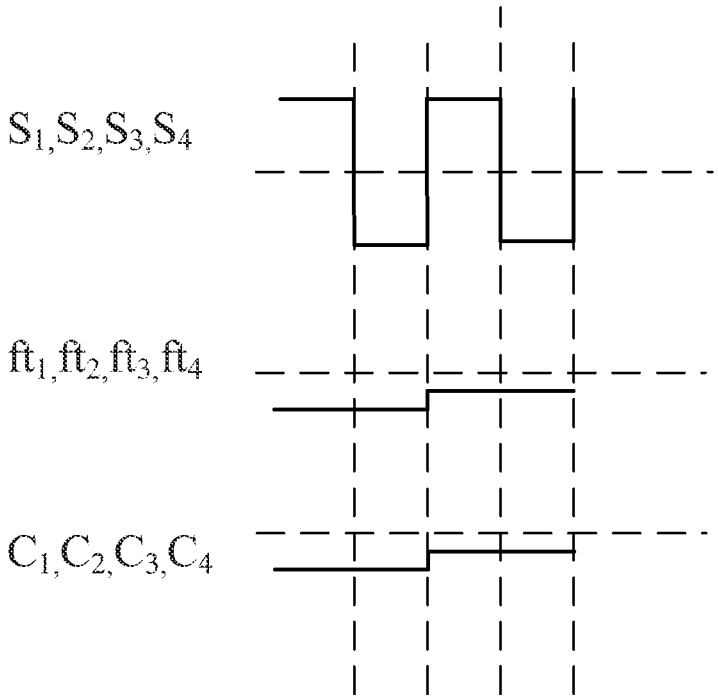
FIG. 6 is a diagram of state changes of signals applied to the pixel array of the active matrix display panel illustrated in FIG. 3 when driving in a dot inversion mode according to an embodiment of the present invention is.

The second embodiment is described by taking a dot inversion mode for an example. FIG. 6 is a diagram of state changes of signals of a pixel array of an active matrix display panel illustrated in FIG. 3 when driving in a dot inversion mode.

In the dot inversion mode, the data signal applied to the data lines S1, S2, S3, S4 is also an alternating square-wave voltage signal. It is assumed that the high level of the data signal is 4V, the low level of the data signal is −4V, and the common electrode voltage originally applied to the common electrode is consistent such as −1V. As illustrated in FIG. 3, the scanning lines G1 and G2 are scanning lines with a first resistance, and the scanning lines G3 and G4 are scanning lines with a second resistance. It is assumed that the second resistance of the scanning lines G3 and G4 is larger than the first resistance of the scanning lines G1 and G2. Therefore, as illustrated in FIG. 6, the feed-through voltages generated by the scanning lines G1 and G2 on the pixel electrodes are larger (e.g., −1V), and the feed-through voltages generated by the scanning lines G3 and G4 on the pixel electrodes are smaller (e.g., −0.5V). Therefore, the common voltage signal applied to the common electrode is adjusted according to the different feed-through voltages generated by the different scanning lines on the pixel electrodes. As illustrated in FIG. 6, the adjusted common electrode signals C1, C2, C3, C4 are an alternating square-wave signal, where the common electrode signals C1 and C2 corresponding to the scanning lines G1 and G2 are −1V, the common electrode signals C3 and C4 corresponding to the scanning lines G3 and G4 are −0.5V. The corresponding level difference compensates the difference of the generated feed-through voltages. Although only a portion of scanning signals is shown, it is understood that the scanning signals are continuous streams of alternating square-wave signals, so are the feed-through signals and the adjusted common voltages.

Therefore, the pixel voltage ultimately applied to each of the pixel units is equal to the target voltage, that is, the pixel voltages applied to the pixel units connected to the scanning lines G1 and G2 are respectively |4V−1V−(−1V)|=4V and |−4V−1V−(−1V)|=4V, and the pixel voltages applied to the pixel units connected to the scanning lines G3 and G4 are respectively |4V−0.5V−(−0.5V)|=4V and |−4V−0.5V−(−0.5V)|=4V.

It should be noted that, in the second embodiment described above, since the common electrode voltage originally applied to the common electrode is constant, the second embodiment may be applied to all of the four inversion modes, i.e., the frame inversion mode, the row inversion mode, the column inversion mode, and the dot inversion mode. However, in the first embodiment described above, since the common electrode voltage originally applied to the common electrode varies, the first embodiment may be applied to the frame inversion mode and the row inversion mode. This is because for the column inversion mode and the dot inversion mode, in each row of the pixel units, adjacent pixel units are required to have different polarities. Since the common electrodes of each row of the pixel units are connected to the same common electrode line, and the row of the pixel units is charged/discharged by the data voltage applied to the data line after the scanning line turns on, the positive polarity and the negative polarity cannot be displayed simultaneously for the row of the pixel units in a case where the common electrode voltage varies. Therefore, the column inversion mode and the dot inversion mode are only applied to the second embodiment described above, i.e., in a case where the common electrode voltages originally applied to the common electrodes are the same.

The first embodiment and the second embodiment described above may also be applied to the pixel array of the active matrix display panel as illustrated in FIG. 4, the nature of the process is similar to that of the process for the first embodiment and the second embodiment, and the description thereof is omitted herein for the sake of brevity.

Figure 7:
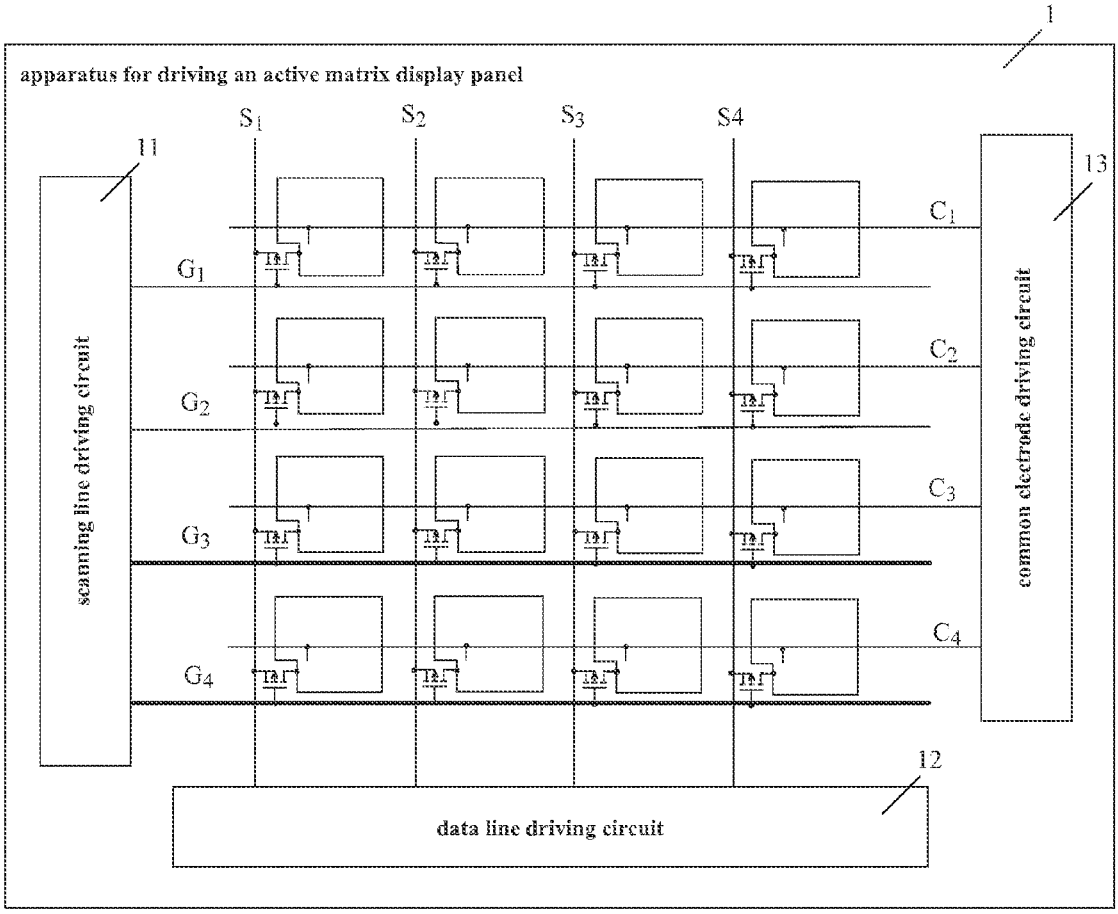
FIG. 7 is a specific structural schematic diagram of an apparatus for driving an active matrix display panel according to an embodiment of the present invention.

Based on the method for driving the active matrix display panel described above, embodiments of the present invention further provide an apparatus for driving an active matrix display panel. FIG. 7 is a structural schematic diagram of an apparatus 1 for driving the active matrix display panel according to the present invention. Referring to FIG. 7, apparatus 1 for driving the active matrix display panel includes a pixel array which may be the pixel array as illustrated in FIG. 3, a scanning line driving circuit 11 configured to supply scanning voltages to scanning lines, a data line driving circuit 12 configured to apply data voltages to data lines, and a common electrode driving circuit 13 configured to apply common voltages to common electrodes. The common electrode driving circuit 13 is configured to adjust the common voltages applied to the common electrodes arranged opposite to pixel electrodes according to differences in voltage changes between/among the pixel electrodes. The voltage changes are generated in the pixel electrodes that are coupled to corresponding scanning lines when the scanning lines change from an on state to an off state, so that a voltage difference between each of the pixel electrodes and a common electrode arranged opposite to the pixel electrode is equal to a target voltage. The adjusted common voltages form an alternating square-wave voltage signal in a continuous period.

Scanning lines with different resistances are used in the pixel array. For example, the scanning lines G1 and G2 are the scanning lines with the same first resistance, the scanning lines G3 and G4 are the scanning lines with the same second resistance different from the first resistance, i.e., the scanning line G1 (or G2) and the scanning line G3 (or G4) are scanning lines with different resistances. For example, the scanning lines G1 and G2 are manufactured with a first material, and the scanning lines G3 and G4 are manufactured with a second material. In an embodiment, the first material is a stack of aluminum/molybdenum, and the second material is a stack of molybdenum/aluminum/molybdenum. But in the practical application, it is not limited to the metal materials described above. In another example embodiment, the scanning lines G1 and G2 have a first line width, and the scanning lines G3 and G4 have a second line width. For another example, the scanning lines G1 and G2, compared with the scanning lines G3 and G4, may be manufactured with different materials and have different line widths.

In an embodiment, common electrode driving circuit 13 may include one or more registers (not shown) configured to store digital values of the common voltages and one or more digital-to-analog circuits (not shown) for converting the stored values into an analog representation. In an embodiment, the common voltages applied to the common electrodes may be adjusted by setting an appropriated register in the common electrode driving circuit 13 during a line blanking period of the scanning line driving circuit 11. The line blanking period includes a period during which a row synchronization signal is at a low level, including a synchronization front porch stage, a synchronization back porch stage, and the like. It is understood that adjusting the common voltages by setting the appropriated register in the common electrode driving circuit 13 during the line blanking period will not affect the normal display of the active matrix display panel.

It should be noted that, for the apparatus for driving the active matrix display panel illustrated in FIG. 7, in the pixel array, the common electrode includes a plurality of common electrode lines (for example, C1, C2, C3 and C4). Each of common electrode lines is disposed opposite to the pixel electrodes that are associated with one of the scanning lines, and the common electrode lines are driven by different output terminals of the common electrode driving circuit 13. Therefore, the common electrode driving circuit 13 may apply different common electrode voltages to each of the common electrode lines.

In other embodiments, in the pixel array, the common electrode includes a plurality of common electrode lines (for example, C1, C2, C3 and C4). Pixel electrodes associated with one of scanning lines are disposed opposite to one of the common electrode lines, and the common electrode lines are driven by a same output terminal of the common electrode driving circuit 13. Therefore, the common electrode driving circuit 13 may apply the same common electrode voltage to the common electrode lines.

Figure 8:
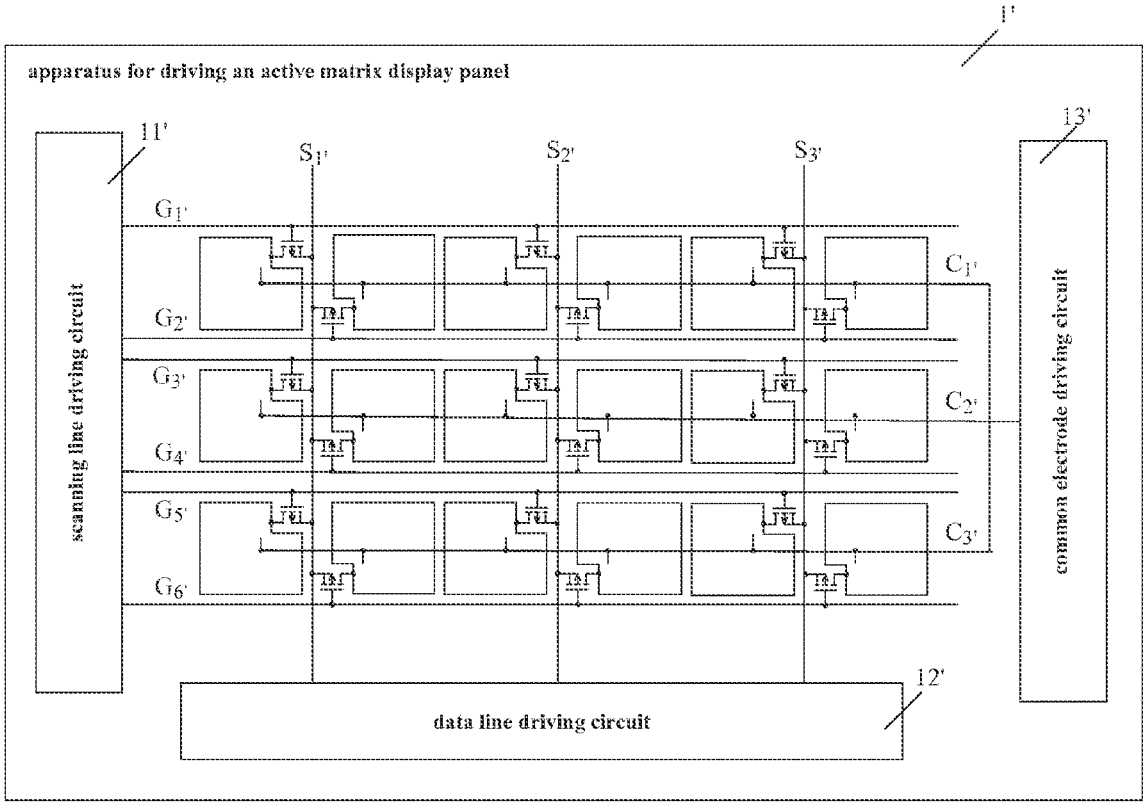
FIG. 8 is a specific structural schematic diagram of another apparatus for driving an active matrix display panel according to an embodiment of the present invention.

According to an embodiment of the present invention, it is further provided another apparatus for driving an active matrix display panel. FIG. 8 is a specific structural schematic diagram of another apparatus for driving the active matrix display panel according to the present invention. Referring to FIG. 8, the apparatus 1' for driving the active matrix display panel includes a pixel array, a scanning line driving circuit 11', a data line driving circuit 12', and a common electrode driving circuit 13'. The pixel array is different from the pixel array in the embodiment described in conjunction with FIG. 7, and the pixel array is the pixel array illustrated in FIG. 4. Functions of the scanning line driving circuit 11', the data line driving circuit 12' and the common electrode driving circuit 13' are the same as those of the embodiment described in conjunction with FIG. 7 above, and the description thereof is omitted herein.

It should be noted that, for the apparatus for driving the active matrix display panel illustrated in FIG. 8, in the pixel array, the common electrode includes a plurality of common electrode lines (for example, C1', C2' and C3'). The pixel electrodes associated with one of the scanning lines are disposed opposite to one of the common electrode lines, and the common electrode lines are driven by a same output terminal of the common electrode driving circuit 13'. Therefore, the common electrode driving circuit 13' may apply a same common electrode voltage to the common electrode lines.

In other embodiments, in the pixel array, the common electrode includes a plurality of common electrode lines (for example, C1', C2' and C3'). Pixel electrodes associated with one of scanning lines are disposed opposite to one of the common electrode lines, and the common electrode lines are driven by different output terminals of the common electrode driving circuit 13'. Therefore, the common electrode driving circuit 13' may apply different common electrode voltages to the common electrode lines.

For the apparatus for driving the active matrix display panel illustrated in FIGS. 7 and 8, in the pixel array, the common electrode may be disposed on a TFT substrate, and may also be disposed on a CF substrate. The active matrix display panel is one of an OLED display panel, an active matrix display panel and an electronic paper panel.

According to an embodiment of the present invention, it is further provided a display including the apparatus for driving the active matrix display panel as illustrated in FIG. 7 or FIG. 8.

In summary, embodiments of the present invention provide many benefits and advantages over the prior art.

For example, in accordance with embodiments the present invention, only the common voltages of the common electrodes are adjusted to counteract the effects of the feed-through voltages on the pixel voltages, and compensate for the voltage changes generated on the pixel electrodes when scanning lines that are coupled to the pixel electrodes change from an on state to an off state. Embodiments of the present invention reduce or eliminate the effects of gradational changes without making change to the structure of the active matrix display panel. Therefore, the complexity of the manufacturing process is reduced, and the production yield is improved.

While the foregoing is directed to embodiments of the present invention, other and further embodiments may be devised without departing from the basic scope thereof, and the scope thereof is determined by the claims that follow.

What is claimed is:

1. A method for driving an active matrix display panel, the active matrix display panel comprising a scanning line driving circuit having a plurality of scanning lines, a plurality of data lines intersecting with the plurality of scanning lines, a plurality of pixel electrodes provided in regions surrounded by adjacent scanning lines and adjacent data lines, each of the pixel electrodes being capacitively coupled to one of the scanning lines and to one of the data lines through an electronic switch, and a common electrode driving circuit configured to drive a plurality of common electrodes arranged opposite to the pixel electrodes; the method comprising:

turning on the scanning lines sequentially, the scanning lines comprising a plurality of first scanning lines having a first resistance and a plurality of second scanning lines, wherein the first scanning lines and the second scanning lines are manufactured with different materials; and adjusting common voltages applied to the common electrodes in response to differences between a first feed-through voltage of the first scanning line and a second feed-through voltage of the second scanning line, so that a voltage difference between each of the pixel electrodes and a common electrode is substantially equal to a target voltage, wherein the first feed-through voltage is a changed voltage generated when the first scanning line changes from an on state to an off state; the second feed-through voltage is a changed voltage generated when the second scanning line changes from an on state to an off state.

2. The method according to claim 1, wherein adjusting common voltages comprises:

setting a register in the common electrode driving circuit during the line blanking period of the scanning line driving circuit.

3. The method according to claim 2, wherein the line blanking period comprises a period during which a row synchronization signal is at a low level.

4. The method according to claim 1, wherein the adjusted common voltages comprise a continuous stream of an alternating square-wave voltage signal.

5. The method for driving the active matrix display panel according to claim 1, wherein the first scanning lines comprise a first stack of metal layers and the second scanning lines comprise a second stack of metal layers; the first stack comprises aluminum/molybdenum, and the second stack comprises molybdenum/aluminum/molybdenum.

6. The method for driving the active matrix display panel according to claim 1, wherein the first scanning lines have a first line width and the second scanning lines have a second line width different from the first line width.

7. The method for driving the active matrix display panel according to claim 1, wherein the common electrodes are arranged on a thin film transistor (TFT) substrate or a color filter (CF) substrate.

8. The method for driving the active matrix display panel according to claim 1, wherein the active matrix display panel is one of an OLED display panel, an active matrix display panel, and an electronic paper panel.

9. A display comprising an active matrix display panel, the active matrix display panel comprising a plurality of scanning lines; a plurality of data lines intersecting with the plurality of scanning lines; a plurality of pixel electrodes provided in regions surrounded by adjacent scanning lines and adjacent data lines, each of the pixel electrodes being capacitively coupled to one of the scanning lines and to one of the data lines through an electronic switch; and a plurality of common electrodes arranged opposite to the pixel electrodes; the display comprising:

a scanning line driving circuit configured to apply scanning voltages to the scanning lines, the scanning lines comprising a plurality of first scanning lines having a first resistance and a plurality of second scanning lines having a second resistance different from the first resistance, wherein the first scanning lines and the second scanning lines are manufactured with different materials;

a data line driving circuit configured to apply data voltages to the data lines; and a common electrode driving circuit configured to apply common voltages to the common electrodes;

wherein the common electrode driving circuit adjusts the common voltages in response to differences between a first feed-through voltage of the first scanning line and a second feed-through voltage of the second scanning line, so that a voltage difference between each of the pixel electrodes and a common electrode is substantially equal to a target voltage, wherein the first feed-through voltage is a changed voltage generated when the first scanning line changes from an on state to an off state; the second feed-through voltage is a changed voltage generated when the second scanning line changes from an on state to an off state.

10. The display according to claim 9, wherein the adjusted common voltages comprise a continuous stream of an alternating square-wave voltage signal.

11. The display according to claim 9, wherein the first scanning lines comprise a first material and the second scanning lines comprise a second material different from the first material.

12. The display according to claim 9, wherein the first scanning lines have a first line width and the second scanning lines have a second line width different from the first line width.

13. The display according to claim 9, wherein the common electrodes are arranged on a thin film transistor (TFT) substrate or a color film (CF) substrate.

14. The display according to claim 9, wherein the active matrix display panel is one of an OLED display panel, an active matrix display panel, and an electronic paper panel.

15. The method according to claim 1, wherein first common electrode lines are oppositely provided with pixel electrodes correspondingly coupled to the first scanning lines; second common electrode lines are oppositely provided with pixel electrodes correspondingly coupled to the second scanning lines;

a first common voltage is applied to all first common electrode lines;

a second common voltage is applied to all second common electrode lines; and the first common voltage is different from the second voltage.

16. The display according to claim 9, wherein first common electrode lines are oppositely provided with pixel electrodes correspondingly coupled to the first scanning lines; second common electrode lines are oppositely provided with pixel electrodes correspondingly coupled to the second scanning lines;

a first common voltage corresponding to the first feed-through voltage is applied to all first common electrode lines;

a second common voltage corresponding to the second feed-through voltage is applied to all second common electrode lines; and the first common voltage is different from the second voltage.

* * * * *